US006783338B2

(12) United States Patent
Moroi et al.

(10) Patent No.: US 6,783,338 B2
(45) Date of Patent: Aug. 31, 2004

(54) SCROLL TYPE COMPRESSOR HAVING TIP SEALS AND A SCROLL COATING LAYER

(75) Inventors: Takahiro Moroi, Kariya (JP); Toshiro Fujii, Kariya (JP); Tatsuyuki Hoshino, Kariya (JP); Masato Sowa, Kariya (JP); Takayuki Hirano, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/209,358

(22) Filed: Jul. 31, 2002

(65) Prior Publication Data

US 2003/0026721 A1 Feb. 6, 2003

(30) Foreign Application Priority Data

Aug. 1, 2001 (JP) ..... 2001-233880

(51) Int. Cl.[7] ..... F04C 18/04; F04C 27/00; F04C 29/04

(52) U.S. Cl. ..... 418/55.2; 418/55.4; 418/83; 418/178

(58) Field of Search ..... 418/55.1, 55.2, 418/55.4, 83, 178

(56) References Cited

U.S. PATENT DOCUMENTS

| | | | | |
|---|---|---|---|---|
| 3,994,633 A | * | 11/1976 | Shaffer | 418/83 |
| 5,584,678 A | * | 12/1996 | Hirooka et al. | 418/55.2 |
| 6,425,746 B1 | * | 7/2002 | Mori et al. | 418/55.2 |
| 2001/0001639 A1 | | 5/2001 | Shaffer | 418/1 |

FOREIGN PATENT DOCUMENTS

| | | | | |
|---|---|---|---|---|
| BE | 1 010 426 A3 | | 7/1998 | |
| BE | 1 010 916 A3 | | 3/1999 | |
| EP | 735 270 A2 | | 10/1996 | F04C/18/02 |
| EP | 1 225 338 A2 | | 7/2002 | F04C/18/02 |
| FR | 2 736 999 | | 1/1997 | F25B/41/00 |
| JP | 57-99202 | * | 6/1982 | 418/55.2 |
| JP | 64-069788 | | 3/1989 | F04C/18/02 |
| JP | 2-149785 | * | 6/1990 | 418/55.4 |
| JP | 2-87990 | | 7/1990 | F04C/18/02 |
| JP | 5-987 | | 1/1993 | F04C/18/02 |
| JP | 7-109982 | | 4/1995 | F04C/18/02 |
| JP | 7-24633 | | 6/1995 | F04C/18/02 |
| JP | 8-105391 | | 4/1996 | F04C/18/02 |
| JP | 8-189482 | | 7/1996 | F04C/18/02 |
| JP | 08-189482 | | 7/1996 | F04C/18/02 |
| JP | 8-247056 | | 9/1996 | F04C/18/02 |
| JP | 8-261171 | | 10/1996 | F04C/18/02 |

* cited by examiner

*Primary Examiner*—John J. Vrablik
(74) *Attorney, Agent, or Firm*—Morgan & Finnegan, LLP

(57) ABSTRACT

A scroll type compressor has a housing, a fixed metal scroll member and a movable metal scroll member. The fixed and the movable scroll members each have a base plate and scroll wall extending therefrom. The fixed scroll member is fixed to the housing. The movable scroll member engages the fixed scroll member to trace an orbital motion when driven by a crank mechanism. The scroll members define compression chambers. Resin tip seals are respectively provided on distal ends of the scroll walls and slidably engage the metallic surfaces of the facing base plates. The tip seals seal the compression chambers. A resin coating layer is formed on a region of at least one of the end surfaces of the base plates that is not contacted by a tip seal.

23 Claims, 4 Drawing Sheets

SCROLL TYPE COMPRESSOR HAVING TIP SEALS AND A SCROLL COATING LAYER

BACKGROUND OF THE INVENTION

The present invention relates to a scroll type compressor and more particularly to a scroll type compressor that inhibits leakage and improves compression efficiency by providing tip seals respectively on the distal ends of the scroll walls of the compressor's fixed and movable scroll members.

Since a scroll type compressor is relatively small and has relatively high efficiency, it is widely employed in both home and vehicular air conditioners. Also, a scroll type compressor that supplies an electrode of a fuel cell (hydrogen-oxygen type) with compressed gas, such as hydrogen, oxygen and air, has been developed.

Basically, the scroll type compressor has a fixed scroll member fixed to a housing of the compressor, a movable scroll member aligned to face the fixed scroll member and a drive source, such as a motor, that drives the movable scroll member. As the movable scroll member orbits, substantially falcate compression chambers defined between the fixed scroll member and the movable scroll member move radially inwardly; that is, the compression chambers move from the outer side adjacent to an inlet of the compressor toward the center adjacent to a discharge port of the compressor, and the volumes of the compression chambers also progressively reduce. Thereby, introducing, compressing and discharging a gas are consecutively performed.

It is desired to ensure sealing performance between the compression chambers by inhibiting gas from leaking from the compression chambers. Reducing such leakage improves compression efficiency of the scroll type compressor. An axial clearance is defined between each scroll wall and a respective facing end surface of each base plate. This clearance may not be zero because of machining inaccuracies, assembly variances and vibration generated upon operation of the compressor. Therefore, reducing the axial clearance between the fixed scroll member and the movable scroll member can improve compression efficiency.

To substantially eliminate the effect of the axial clearance, tip seals are respectively provided on distal ends of the scroll walls. The tip seals are fitted and held in grooves that are respectively recessed on the distal ends and can move in the grooves. The tip seals slide on the facing end surfaces of the base plates in accordance with the orbital motion of the movable scroll member and determine the clearance between the distal ends and the respective facing end surfaces. Thereby, sealing performance between the compression chambers is ensured.

To improve compression efficiency of the compressor, not only the axial clearance but also a radial clearance is preferably as small as possible. However, since the radial clearance is defined between coadjacent side surfaces of the scroll walls, the radial clearance cannot be adjusted by providing the above-mentioned tip seal. Therefore, the clearance between the coadjacent side surfaces of the scroll walls is designed to be reduced as much as possible. As the radial clearance becomes smaller, scratching can easily arise between the coadjacent side surfaces of the scroll walls. Therefore, resin coating layers are formed on the coadjacent side surfaces of the scroll walls. Thereby, the coadjacent side surfaces of the scroll walls are inhibited from scratching and slanting.

When the resin coating layers are formed not only on the coadjacent side surfaces of the scroll walls but also on the end surfaces of the base plates, the tip seals consequently slide on the resin coating layers. When the tip seals are made of resin, coefficient of friction between the tip seals and the respective resin coating layers is relatively extremely large. Additionally, in such a state, the tip seals and the respective resin coating layers progressively abrade, with a consequence of producing a large amount of abrasion dust. An increase in coefficient of friction undesirably causes a decrease in compression efficiency of the compressor. Also, as a large amount of abrasion dust is produced, the abrasion dust undesirably causes trouble of a various kinds of bearings and valves that are disposed downstream of the compressor.

Japanese Examined Utility Model Publication No. 7-24633 discloses a scroll type compressor that includes resin coating layers only on side surfaces of its scroll walls and that does not include the resin coating layers on end surfaces of its base plates that slide on tip seals. Also, Japanese Examined Patent Publication No. 6-15867, in a scroll type compressor without a tip seal, discloses that upon sliding between resins, even if contact pressure is relatively low, coefficient of friction between the resins becomes relatively large and the amount of abrasion rapidly increases. Based on these Publications, sliding between metal and resin is preferable.

In the Japanese Examined Utility Model Publication No. 7-24633, resin coating layers are formed only on the side surfaces of the scroll walls and are not formed on the end surfaces of the base plates. Namely, the resin coating layers are not formed on the entire end surfaces of the base plates, irrespective of a sliding region of the tip seals.

Therefore, an extra clearance is defined between the distal ends of the scroll walls and the respective facing end surfaces of the base plates on the opposite side of the compression chambers relative to the tip seals, and compressed gas leaks from the relatively high pressure compression chambers to the relatively low pressure clearance. Thereby, volumetric efficiency reduces and loss of re-compression increases, with a consequence of deteriorating compression efficiency of the compressor. It is desired that compression efficiency of the scroll type compressor is improved by inhibiting gas from leaking from the relatively high pressure compression chambers to the clearance.

SUMMARY OF THE INVENTION

In accordance with the present invention, a scroll type compressor has a housing, a crankshaft, a fixed scroll member, a movable scroll member, a fixed scroll tip seal and a movable scroll tip seal. The crankshaft is supported by the housing and is connected to a drive source. The fixed scroll member made of metal is fixed to the housing and has a fixed scroll base plate from which extends a fixed scroll wall. The movable scroll member, also made of metal, has a movable scroll base plate from which extends a movable scroll wall whose wall surfaces engage the wall surfaces of the fixed scroll member in a well-known manner at moving lines of contact as the movable scroll member orbits relative to the fixed scroll member. The movable scroll member is driven by the crankshaft connected to the drive source. The fixed scroll base plate, the fixed scroll wall, the movable scroll base plate and the movable scroll wall define compression chambers. Gas is compressed by the progressively reducing volumes of the compression chambers in accordance with the orbital motion of the movable scroll member relative to the fixed scroll member. The fixed scroll tip seal made of resin is provided on a distal end of the fixed scroll wall and slides on the movable scroll base plate. The movable scroll tip seal made of resin is provided on a distal end of the movable scroll wall and slides on the fixed scroll base plate. The fixed scroll tip seal and the movable scroll tip seal seal the compression chambers. A resin coating layer is formed on the end surfaces of at least one of the movable scroll base plate and the fixed scroll base plate other than a sliding region where the fixed scroll tip seal slides and/or a sliding region where the movable scroll tip seal slides.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention will now be described with reference to FIGS. 1 to 3. The front side and the rear side correspond to the left side and the right side in FIG. 1, respectively.

Figure 1:
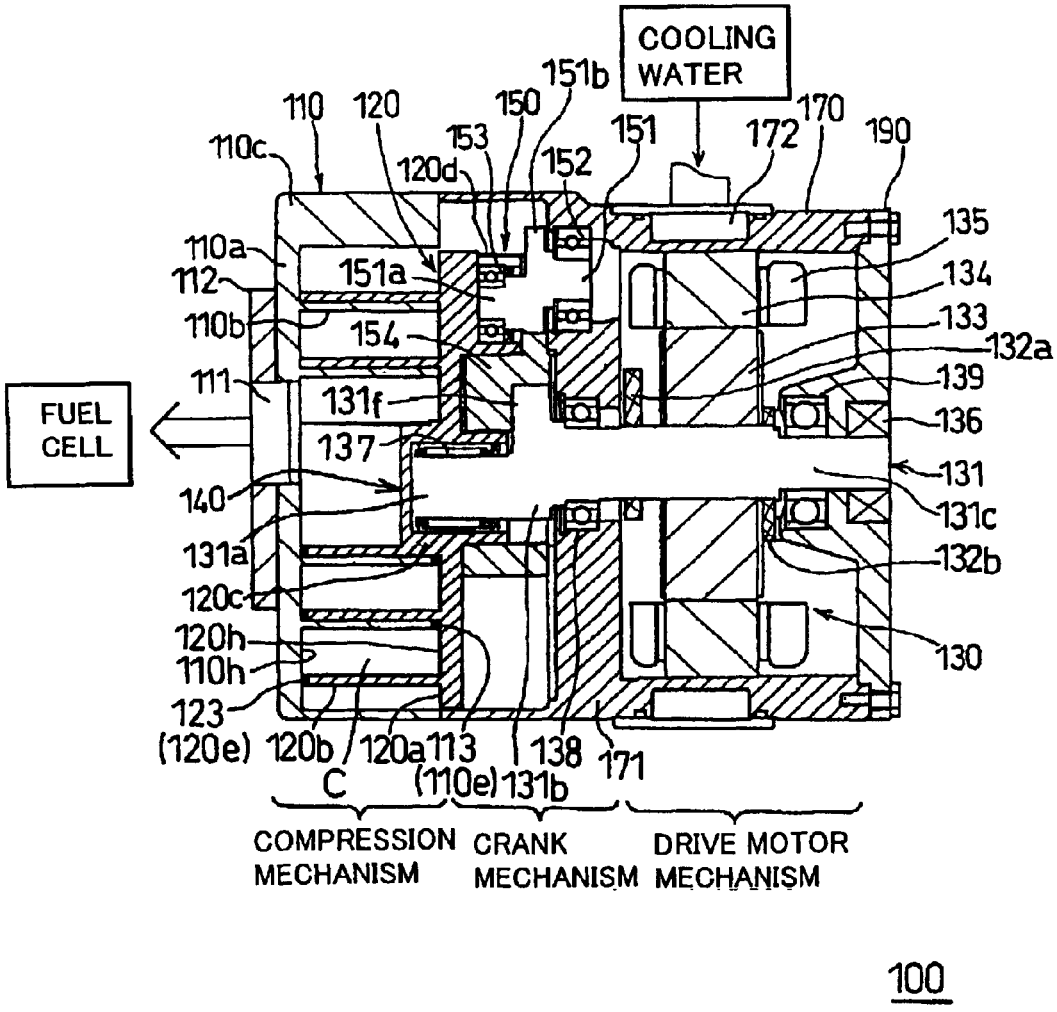
FIG. 1 is a longitudinal cross-sectional view of a scroll type air compressor for a fuel cell according to an embodiment of the present invention.
Figure 2:
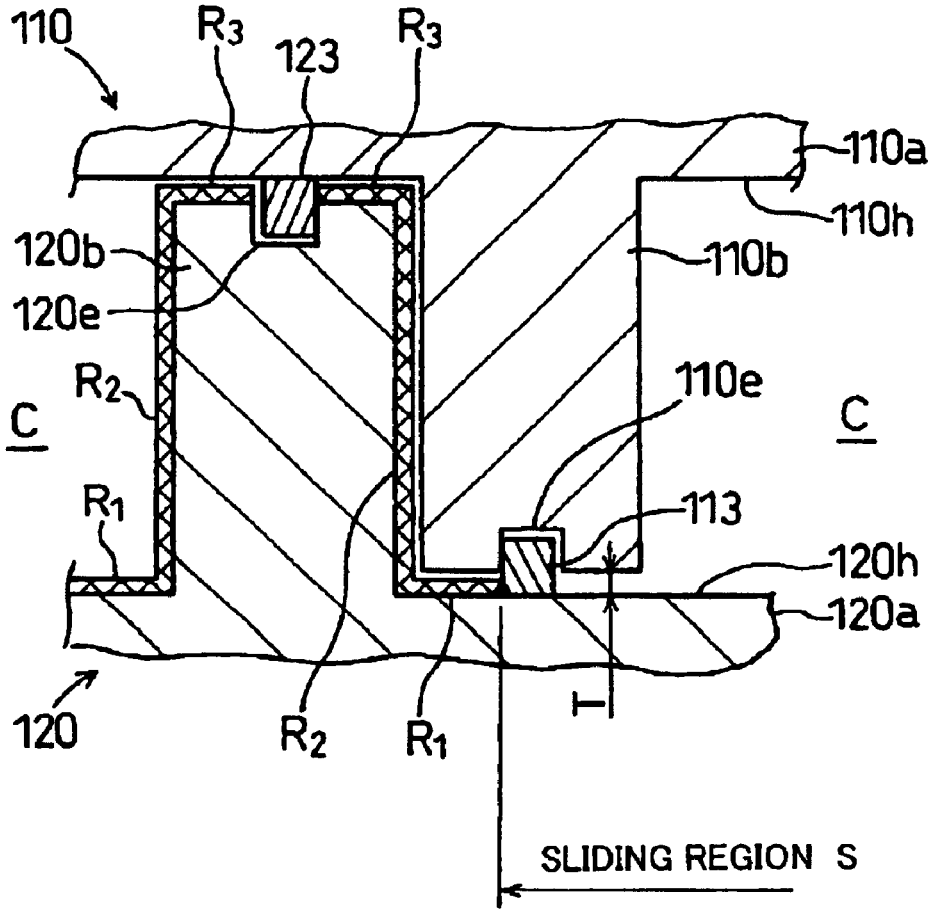
FIG. 2 is a partially enlarged cross-sectional view of a movable scroll member and a fixed scroll member according to the embodiment of the present invention.

As shown in FIG. 1, a scroll type air compressor 100 for use in a fuel cell includes a compression mechanism, a crank mechanism and a drive motor mechanism.

The compression mechanism includes a fixed scroll member 110 and a movable scroll member 120. The fixed scroll member 110 includes a disk-shaped fixed scroll base plate 110*a*, a fixed scroll wall 110*b* and an outer wall 110*c*. The fixed scroll wall 110*b* extends from the fixed scroll base plate 110*a*. The outer wall 110*c* surrounds the fixed scroll wall 110*b*. The fixed scroll base plate 110*a* and the outer wall 110*c* integrally form a front housing. A discharge port 111 that connects with an oxygen electrode of the fuel cell is formed at the center of the fixed scroll base plate 110*a*. The fixed scroll member 110 is made of an aluminum alloy, and the entire surface of the fixed scroll member 110 on the side of the fixed scroll wall 110*b* is performed with alumite treatment.

A water jacket 112 or a cooler is fixed onto the fixed scroll base plate 110*a* by bolts (not shown in FIG. 1) so as to surround the discharge port 111. The water jacket 112 includes cooling fins inside, and cooling water circulates within a water passage defined by the cooling fins to extract heat from the fixed scroll member 110. The cooling water is supplied to the water jacket 112 from the outside through a water inlet (not shown in FIG. 1).

The movable scroll member 120 also includes a disk-shaped movable scroll base plate 120*a* and a movable scroll wall 120*b*. The movable scroll wall 120*b* extends from the movable scroll base plate 120*a*. A cylindrical boss 120*c* having an opening at one end is provided at the center of the rear end of the movable scroll base plate 120*a*, and three cylindrical recesses 120*d* are arranged in equiangular positions at the outer side of the boss 120*c*. The movable scroll member 120 is also made of an aluminum alloy. However, the surface of the movable scroll member 120 on the side of the movable scroll wall 120*b* is performed not with alumite treatment but with resin coating treatment with a resin coating layer R, which will be described later. The movable scroll member 120 is aligned to engage with the fixed scroll member 110.

A groove 110*e* is recessed on the distal end of the fixed scroll wall 110*b*, and a fixed scroll tip seal 113 is fitted in the groove 110*e*. Likewise, another groove 120*e* is recessed on the distal end of the movable scroll wall 120*b*, and a movable scroll tip seal 123 is fitted in the groove 120*e*. The fixed scroll tip seal 113 slides on an end surface 120*h* of the movable scroll base plate 120*a*, and the movable scroll tip seal 123 slides on an end surface 110*h* of the fixed scroll base plate 110*a*.

The crank mechanism includes a drive crank mechanism 140 and a self-rotation blocking mechanism 150. The drive crank mechanism 140 drives the movable scroll member 120 to orbit (orbital motion). The self-rotation blocking mechanism 150 blocks the movable scroll member 120 from self-rotating so that it follows an orbital path only.

The drive crank mechanism 140 includes a crank pin 131*a* of a drive crankshaft 131 and a roller bearing 137. The roller bearing 137 is a grease-encapsulated type and rotatably supports the crank pin 131*a*.

Also, the self-rotation blocking mechanism 150 includes the above-mentioned cylindrical recesses 120*d*, a crank pin 151*a* of each crankshaft 151 and radial ball bearings 153. The radial ball bearings 153 are grease-encapsulated types and each rotatably support the respective crank pins 151*a*.

Additionally, the front end of the drive crankshaft 131 is supported by a support frame 171 through a grease-encapsulated ball bearing 138. Also, grease-encapsulated ball bearings 152 respectively support the rear end of the crankshafts 151.

A balance weight 154 is affixed to a flange 131*f* at the main shaft section 131*b* of the drive crankshaft 131 by four bolts (not shown in the drawings). Also, balance weights 151*b* are provided for the crankshafts 151. Thereby, vibration due to the orbital motion of the movable scroll member 120 is reduced.

The crank mechanism together with the drive motor mechanism is accommodated in a center housing 170. The crank mechanism and the drive motor mechanism are separated by the support frame 171 integrally formed at approximately the center of the center housing 170. The above-described ball bearing 138 and the ball bearings 152 are fitted in the support frame 171.

The drive motor mechanism includes the center housing 170, a rear housing 190 and a drive motor 130. The drive motor 130 is accommodated between the center housing 170 and the rear housing 190. The drive motor 130 is an induction motor that includes a drive shaft 131*c*, a rotor 133 and a stator 134. The drive shaft 131*c* extends along a central axis of the compressor. The rotor 133 is fitted to the drive shaft 131*c*. The stator 134 is located outside the rotor 133, and includes a stator winding 135. The rotating speed of the drive motor 130 is controlled by an inverter (not shown in the drawings). Also, a water jacket 172 is provided at substantially the center of the center housing 170 that surrounds the drive motor 130 in the vicinity of the stator 134. Thereby, cooling water extracts heat from the unit and cools the drive motor 130. A single cooling system may be combined by interconnecting the water jacket 112 and the water jacket 172.

Balancers 132*a* and 132*b* are secured to the drive shaft 131*c* and are respectively frontward and rearward to the rotor 133. Thereby, a moment of inertia in the radial direction of the drive crankshaft 131, that is, in the offset direction of the crank pin 131*a*, is balanced. In the present embodiment, the drive shaft 131*c* of the drive motor 130, the main shaft 131*b* of the drive crankshaft 131 and the crank pin 131*a* are components of the drive crankshaft 131.

The rear housing 190 is secured to the rear end of the center housing 170 by bolts, and a motor chamber that accommodates the drive motor 130 is defined between the rear housing 190 and the center housing 170. A ball bearing 139 and a seal member 136 are provided at the center of the rear housing 190. The drive shaft 131*c* is supported in the rear housing 190 by the ball bearing 139. The seal member 136 seals the motor chamber.

When the drive motor 130 is supplied with an electric current, the drive crankshaft 131 rotates, and the drive crank mechanism 140 causes the movable scroll member 120 to orbit relative to the fixed scroll member 110. Thereby, air introduced from an inlet (not shown in the drawings) into the compression chamber C defined between the fixed scroll member 110 and the movable scroll member 120, is compressed by the progressively reducing volume of the compression chamber C as the movable scroll member 120 traces an orbital motion relative to the fixed scroll member 110. The compressed air is discharged through the discharge port 111, where it is supplied to an oxygen electrode of the fuel cell.

The fuel cell generates electricity by chemical reaction between oxygen in the air that is supplied from the compressor 100 and hydrogen. When lubricant oil is contained in the compressed gas supplied to the fuel cell, the lubricant oil causes the electrode of the fuel cell to be damaged. Therefore, a scroll type compressor that is not lubricated by lubricant oil is appropriate for the fuel cell. Additionally, the fuel cell may be an alkaline solution type, a polymer electrolyte type, a phosphoric acid type, a molten carbonate type or a solid oxide type. The fuel cell may be used for an electric vehicle or power generation for domestic use.

The resin coating layer will be described with reference to FIG. 2, which illustrates in cross-section the coadjacent fixed scroll wall 110*b* and the movable scroll wall 120*b* at the line of contact defining the small-volume end of one of the compression chambers C. As shown in FIG. 2, in the present embodiment, the resin coating layer R is formed only on the movable scroll member 120 and is not formed on the fixed scroll member 110. The fixed scroll member 110 is only performed with alumite treatment. The resin coating layer R formed on the movable scroll member 120 includes an end surface layer R1, a side surface layer R2 and a distal end surface layer R3.

The end surface layer R1 is spirally formed on a part of the end surface 120*h* of the movable scroll base plate 120*a*, leaving uncovered a sliding region S on which the tip seal 113 slides. The end surface layer R1 occupies the axial clearance T defined at the opposite side of the compression chamber C relative to the tip seal 113. Accordingly, the volume of the clearance through which compressed gas in the compression chambers C may escape is greatly reduced. This improves the volumetric efficiency of the compressor.

The tip seal 113 is movable within the groove 110*e*. Therefore, as pressure in the compression chamber C increases, the tip seal 113 is pressed against the end surface 120*h* and an edge of the end surface layer R1 due to pressure applied in the groove 110*e*. Since the tip seal 113 contacts not only the left side of the groove 110*e* but also an edge of the end surface layer R1, slanting of the tip seal 113 is inhibited, and sealing performance of the side surface of the tip seal 113 further improves. Thereby, the tip seal 113 more effectively seals the compression chamber C.

In the present embodiment, upon operation of the compressor 100, the fixed scroll wall 110*b* and the movable scroll wall 120*b* are configured to maintain a slight clearance therebetween. However, the scroll walls 110*b* and 120*b* may nevertheless contact and slide on each other due to vibration upon transition or due to unexpected causes. Therefore, in the present embodiment, the side surfaces of the movable scroll wall 120*b* are also covered with a side surface resin coating layer R2. Thereby, potential scraping and slanting between the fixed scroll wall 110*b* and the movable scroll wall 120*b* are inhibited.

Also, the distal end surface of the movable scroll wall 120*b*, other than the groove 120*e*, is also covered with the resin coating layer, that is, the distal end surface layer R3. Thereby, even if the end surface 110*h* of the fixed scroll base plate 110*a* should contact the distal end of the movable scroll wall 120*b*, the presence of the layer R3 prevents scratching of the contacting surfaces. Further, due to the distal end surface layer R3, the axial clearance through which gas may leak is diminished, thereby reducing leakage of compressed gas from higher pressure compression chamber C to those at lower pressure. Likewise, sealing performance between the end surface 110*h* and the tip seal 123 is improved in the same manner described above with respect to the end surface 120*h* and the tip seal 113.

In the present embodiment, no resin coating layer is formed on the fixed scroll member 110 that provides the water jacket 112. Therefore, heat generated in the compression chambers C is more readily transmitted to the fixed scroll base plate 110*a* and the fixed scroll wall 110*b* to the water jacket 112. Thereby, extraction of the heat generated in the compression chambers C is not impeded by the resin coating layers R1, R2, R3 on the movable scroll member 120.

In the present embodiment, since resin slides on metal between the distal ends of the scroll members 110 and 120 and the facing end surfaces 120*h* and 110*h*, respectively, the compressor 100 operates smoothly without lubrication by lubricant oil. When an appropriate clearance is maintained between the side surfaces of the fixed scroll wall 110*b* and the movable scroll wall 120*b*, lubrication by lubricant oil is basically not required. However, even if the side surfaces of the scroll walls 110*b* and 120*b* come into sliding contact, lubrication by lubricant oil is not required, since the side surfaces of at least one of the scroll walls 110*b* and 120*b* is covered with the resin coating layer. Accordingly, the movable scroll member 120 can orbit relative to the fixed scroll member 110 without lubrication by lubricant oil. Lubricant oil is not used for lubrication. However, circulating fluid itself or condensed fluid or atomized water may be used for lubrication.

The resin coating layer R may be made of fluororesin such as polytetrafluoroethylene (PTFE), perfluoroalkoxy (PFA) and fluoroethylenepropylene (FEP).

The tip seals 113 and 123 may be made of resin such as polyphenylenesulfide (PPS), polyimide (PI), polyetheretherketone (PEEK) and polytetrafluoroethylene (PTFE). The tip seals 113 and 123 may improve their strength and thermal conductivity by incorporating certain fillers therein.

In the present embodiment, the fixed scroll member 110 and the movable scroll member 120 are made of an aluminum alloy. However, the fixed scroll member 110 and the movable scroll member 120 may be made of other light metals such as pure aluminum or of a metal such as cast iron and steel. Additionally, as far as the sliding region on which the tip seal or the resin coating layer slides is constituted of a kind of metal material, the material of all parts of the scroll members 110 and 120 does need not be identical. For example, the material constituting the sliding region may be different than that constituting other areas of a scroll member.

In the present embodiment, the entire surface of the fixed scroll member 110 on the side of the fixed scroll wall 110*b* is performed with alumite treatment. However, for example, only the part of fixed scroll member 110 where the movable scroll tip seal 123 slides and where the resin coating layer R slides may be performed with alumite treatment. Also, for example, the surface of movable scroll member 120 on the side of the movable scroll wall 120*b* may be performed with alumite treatment in the same manner of that of the fixed scroll member 110. Also, the metal surfaces may be treated by a various kinds of surface treatments. When the material of the scroll members 110 and 120 are steel, the material may be subjected to at least one of quenching, tempering, nitriding and carburizing. The material and the treatment may be selected according to the relation between sliding materials, durability and cost.

In the present embodiment, the resin coating layer R is formed on the side surface of the movable scroll wall 120*b*. However, the resin coating layer R may instead be formed on the side surfaces of the fixed scroll wall 110*b*.

In the present embodiment, the resin coating layer R is formed on the distal end of the movable scroll wall 120*b*. However, the resin coating layer R may instead be formed on the distal end of the fixed scroll wall 110*b*.

One method for forming the resin coating layer on the movable scroll member 120 is as follows. First, a resin solution for coating is prepared. Then the resin solution is uniformly sprayed on the entire surface of the movable scroll member 120 from the movable scroll wall 120*b* side, and the sprayed resin solution is dried. The spraying and the drying are repeated until the desired thickness of the resin coating layer R is formed. After that the sliding region S of the tip seal 113 is removed by machining. The machining can be performed by a numerically-controlled machine tool such as a machining center and an NC miller. The end mill of the machine can be programmed to move precisely. Also, the surface roughness of the movable scroll member 120 that is covered with the resin coating layer R is not critical. However, when the surface of the movable scroll member 120 has a certain roughness, the resin coating layer R adheres to the movable scroll member 120 more firmly. Moreover, since the surface roughness of the end surface 120*h* requires relatively high accuracy, the end surface 120*h* is preferably machined to have a desired surface roughness upon the above-mentioned machining process.

The part of distal end surface layer R3 that corresponds to the groove 120*e* is removed by machining the groove 120*e* after forming the resin coating layer R.

Figure 3:
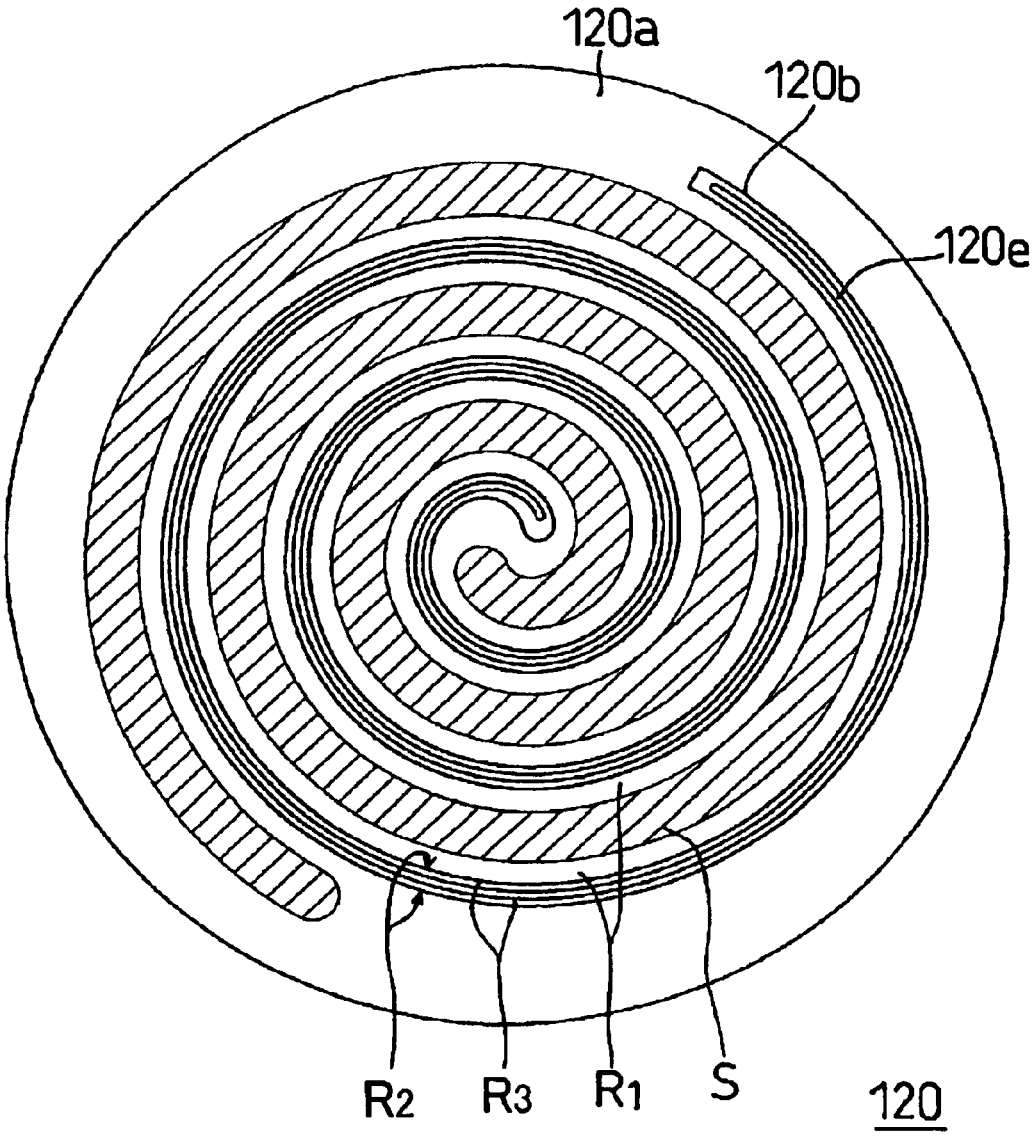
FIG. 3 is an end view of the movable scroll member according to the embodiment of the present invention.

FIG. 3 is a plan view of the front end of the movable scroll member 120 that has been coated with a resin in accordance with the above-described processes. The hatching in FIG. 3 indicates the sliding region S that is formed by removing the part of resin coating layer R after the resin coating layer R is formed.

Figure 4:
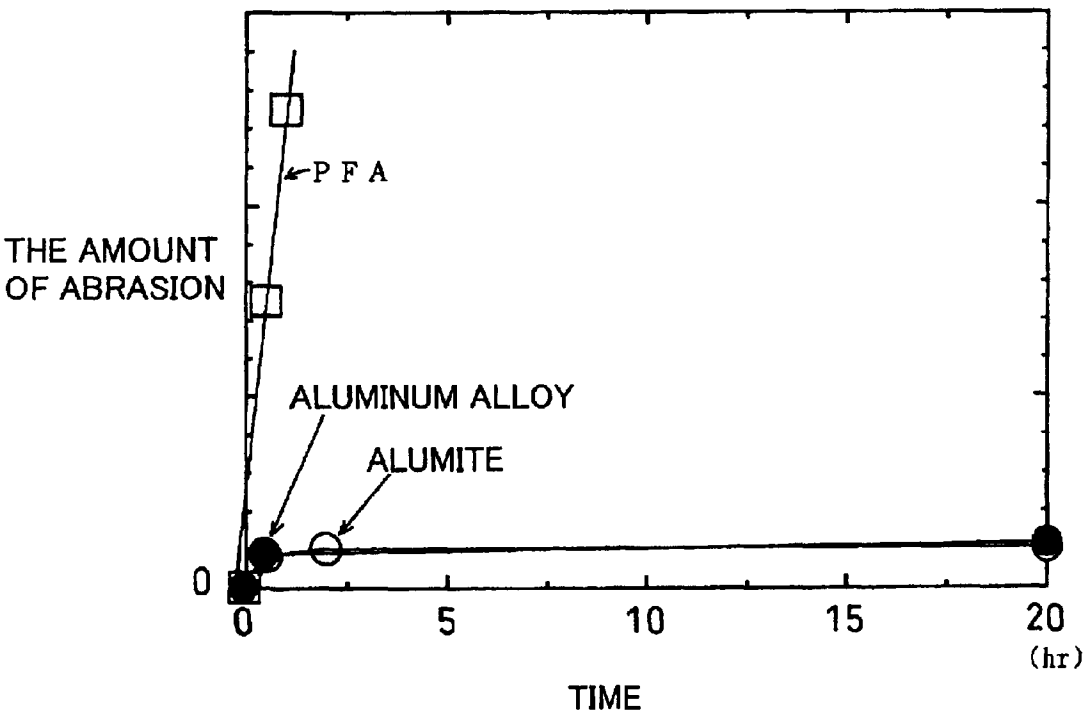
FIG. 4 is a graph indicating a result of a thrust abrasion resistance test of a tip seal in the compressor against various kinds of materials that constitute a base plate of the movable scroll member.

A comparison of the amount of abrasion for different materials in the scroll member end surfaces is shown in FIG. 4 based on thrust abrasion resistance test results. A tip seal utilized in the test is made of polytetrafluoroethylene (PTFE). Three different facing materials, that is, materials of the end surfaces were tested; a non-covered aluminum alloy, an aluminum alloy covered with a resin coating layer made of perfluoroalkoxy (PFA) and an aluminum alloy performed with alumite treatment. As shown in FIG. 4, the tip seal made of resin and either the aluminum alloy surface on the alumite treated surface is a relatively good combination. Those combinations hardly abraded except initial abrasion that is the abrasion just after applying thrust. In stark comparison, the PTFE tip seal and the PFA resin coating layer is a relatively bad combination; indeed, the resin coating layer abrades almost completely away within a short time.

The present examples and embodiments are to be considered as illustrative and not restrictive, and the invention is not to be limited to the details given herein but may be modified within the scope of the appended claims.

What is claimed is:

1. A scroll type compressor comprising: a housing;

a crankshaft supported by the housing, the crankshaft being connected to a drive source;

a fixed metal scroll member having a fixed scroll base plate and a fixed scroll wall that extends from the fixed scroll base plate, the fixed scroll member being fixed to the housing;

a movable metal scroll member having a movable scroll base plate and a movable scroll wall extending therefrom toward the fixed scroll base plate, the movable scroll member being coupled to the crankshaft so as to have an orbital motion relative to the fixed scroll member when the crankshaft is driven by the drive source, the fixed scroll member and the movable scroll member defining compression chambers of progressively reducing volumes in accordance with the orbital motion of the movable scroll member;

a fixed scroll resin tip seal on a distal end of the fixed scroll wall in direct sliding engagement with the end surface of the movable scroll base plate;

a movable scroll resin tip seal on a distal end of the movable scroll wall in direct sliding engagement with the end surface of the fixed scroll base plate, and a first resin coating layer on a region of the end surface of at least one of the movable scroll base plate and the fixed scroll base plate that is not in sliding engagement with a respective one of the fixed scroll resin tip seal and movable scroll resin tip seal, the first resin coating layer not extending into a sliding region of the respective fixed scroll resin tip seal or movable scroll resin tip seal.

2. The scroll type compressor according to claim 1 further comprising: a third resin coating layer on the distal end surface adjacent the tip seal of at least one of the fixed scroll wall and the movable scroll wall.

3. The scroll type compressor according to claim 1 further comprising: a cooler disposed adjacent the fixed scroll member to extract heat therefrom, the first resin coating layer being on the end surface of the movable scroll member.

4. The scroll type compressor according to claim 1, wherein the first resin coating layer is selected from the group consisting of polytetrafluoroethylene, perfluoroalkoxy and fluoroethylenepropylene.

5. The scroll type compressor according to claim 1, wherein the material constituting the fixed scroll resin tip seal and the movable scroll resin tip seal is selected from the group consisting of polyphenylenesulfide, polyimide, polyetheretherketone and polytetrafluoroethylene.

6. The scroll type compressor according to claim 1, wherein the fixed scroll resin tip seal and the movable scroll resin tip seal each are constituted of resin containing a filler.

7. The scroll type compressor according to claim 1, wherein the compressor compresses air.

8. The scroll type compressor according to claim 1 further comprising: a second resin coating layer on one of coadjacent side surfaces of the fixed scroll wall and the movable scroll wall.

9. The scroll type compressor according to claim 8, wherein an uncoated surface of the other of the coadjacent side surfaces of the fixed scroll wall and the movable scroll wall is constituted of metal.

10. The scroll type compressor according to claim 9, wherein the metal is selected from the group consisting of aluminum and aluminum alloy.

11. The scroll type compressor according to claim 1, wherein at least one of the end surfaces of the fixed scroll base plate and the movable scroll base plate in sliding engagement with a respective movable scroll resin tip seal and fixed scroll resin tip seal is constituted of metal.

12. The scroll type compressor according to claim 11, wherein the metal is selected from the group consisting of aluminum and an aluminum alloy.

13. The scroll type compressor according to claim 12, wherein the metal is performed with alumite treatment.

14. The scroll type compressor according to claim 1, wherein the fixed scroll member and the movable scroll member each are constituted of a metal selected from the group consisting of cast iron and steel.

15. The scroll type compressor according to claim 14, wherein at least one of the end surfaces of the fixed scroll base plate and the movable scroll base plate in engagement with a scroll wall resin tip seal is treated by at least one of quenching, tempering, nitriding and carburizing.

16. The scroll type compressor according to claim 1, wherein the movable scroll member orbits relative to the fixed scroll member without lubrication by lubricant oil.

17. The scroll type compressor according to claim 16 further comprising: a fuel cell having an electrode connected to receive gas compressed in the compression chambers.

18. The scroll type compressor according to claim 17, wherein the fuel cell is selected from the group consisting of an alkaline solution type, a polymer electrolyte type, a phosphoric acid type, a molten carbonate type and a solid oxide type.

19. A scroll type compressor comprising:

a housing;

a metal fixed scroll member fixed to the housing, the fixed scroll member having a fixed scroll base plate and a fixed scroll wall extending therefrom;

an orbiting metal movable scroll member having a movable scroll base plate and a movable scroll wall extending therefrom and aligned to engage with the fixed scroll member upon orbiting, the fixed scroll member and the movable scroll member defining compression chambers;

a fixed scroll resin tip seal on a distal end of the fixed scroll wall in direct sliding engagement with the movable scroll base plate;

a movable scroll resin tip seal on a distal end of the movable scroll wall in direct sliding engagement with the fixed scroll base plate; and a resin coating layer on a region of the end surface of at least one of the movable scroll base plate and the fixed scroll base plate that is not in contact with a respective one of the fixed scroll resin tip seal and movable scroll resin tip seal, the resin coating layer not extending into a sliding region of the respective one of the fixed scroll resin tip seal and movable scroll resin tip seal.

20. The scroll type compressor according to claim 19 further comprising: another resin coating layer on one of coadjacent side surfaces of the fixed scroll wall and the movable scroll wall.

21. The scroll type compressor according to claim 19 further comprising: a cooler provided on the fixed scroll member to extract heat therefrom, the resin coating layer being on the movable scroll member side.

22. The scroll type compressor according to claim 19, wherein the movable scroll member orbits relative to the fixed scroll member without lubrication by lubricant oil.

23. The scroll type compressor according to claim 22, wherein gas compressed in the compression chambers is supplied to an electrode of a fuel cell.

* * * * *